United States Patent [19]

McEver et al.

[11] Patent Number: 4,496,162

[45] Date of Patent: Jan. 29, 1985

[54] WELL SEALING ASSEMBLY HAVING RESILIENT SEAL RING WITH METAL END CAPS

[75] Inventors: James P. McEver; James Lewandowski, both of Houston, Tex.

[73] Assignee: Cameron Iron Works, Inc., Houston, Tex.

[21] Appl. No.: 410,503

[22] Filed: Aug. 23, 1982

[51] Int. Cl.[3] ..... F16J 15/12; E21B 33/128

[52] U.S. Cl. ..... 277/9.5; 277/30; 277/108; 277/116.2; 277/121; 277/235 R; 277/236; 285/141; 166/123; 166/140; 166/182

[58] Field of Search ..... 277/9, 9.5, 11, 30, 277/108, 116.2, 116.8, 117-122, 166, 228, 229, 234, 235 R, 235 A, 235 B, 236; 285/139-141; 166/118, 123, 125, 140, 182

[56] References Cited

U.S. PATENT DOCUMENTS

| | | | |
|---|---|---|---|
| 488,434 | 12/1892 | Houston | 277/120 X |
| 1,845,238 | 2/1932 | Church et al. | 277/9 |
| 1,909,663 | 5/1933 | Crickmer | 277/235 R |
| 2,637,400 | 5/1953 | Brown et al. | 277/235 R X |
| 3,389,917 | 6/1968 | McGill et al. | 277/116.2 X |
| 3,797,864 | 3/1974 | Hynes et al. | 285/140 |
| 3,893,717 | 7/1975 | Nelson | 285/141 X |
| 4,008,898 | 2/1977 | Weldon | 277/116.2 |
| 4,138,144 | 2/1979 | Pierce | 277/235 R X |
| 4,232,889 | 11/1980 | Putch | 285/141 |
| 4,381,114 | 4/1983 | Vanderford | 277/34.6 |

FOREIGN PATENT DOCUMENTS

| | | | |
|---|---|---|---|
| 969210 | 6/1975 | Canada | 277/236 |
| 799313 | 3/1936 | France | 277/235 R |
| 914937 | 1/1963 | United Kingdom | 277/235 R |

*Primary Examiner*—Robert S. Ward

*Attorney, Agent, or Firm*—Vinson & Elkins

[57] ABSTRACT

A well annulus sealing assembly having a body with a seal ring assembly including a resilient ring with thin metal end caps, and radial energizing means including a body with a first outer surface and an enlarged outer surface with means for moving the seal ring assembly from the first outer surface to the enlarged outer surface.

4 Claims, 4 Drawing Figures

WELL SEALING ASSEMBLY HAVING RESILIENT SEAL RING WITH METAL END CAPS

BACKGROUND

Well seal assemblies which contain high pressure, highly corrosive well fluids by sealing the annulus between inner and outer concentric well members must not only resist the corrosive effects of the well fluids but must also resist movement of the seal ring from its desired position during the operation of running the assembly into the well and also after having been set and energized.

A prior art seal in such environment is shown in U.S. Pat. No. 4,043,391 wherein the seal ring is set by movement onto a larger diameter portion of the body on which it is mounted and the seal ring includes coil springs at its four corners to prevent their extrusion.

In an application filed Nov. 23, 1981, assigned Ser. No. 324,125, and now U.S. Pat. No. 4,381,114, a wellhead seal was disclosed including a resilient ring having a concave outer portion with upper and lower metal ring caps which are held in sealing engagement with their respective sealing surfaces responsive to fluid pressure which is exerted on the outer concave surface of the resilient ring.

While both of the above seals have been used to provide a desired annulus seal, the second seal assembly cannot be energized within a well bore and the first seal assembly does not protect against corrosive fluids.

Another prior well annulus seal is disclosed in U.S. Pat. No. 3,797,864. This seal includes a resilient packing ring positioned between upper and lower support rings and energized by axial loading to cause the packing ring and lips on the support rings to move radially outward and inward into engagement with opposite surfaces of the annulus.

SUMMARY

The present invention relates to an improved well annulus seal. The improved sealing assembly is mounted on a tubular body, which is adapted to be lowered into a well housing to be seated and connected thereto and has external surfaces facing the inner housing surface which external surfaces include a small diameter upper surface, a larger diameter lower surface and a tapered surface therebetween; a sealing assembly having a resilient ring with metal end caps thereon and in unset position surrounding the upper surface of the body; and means for moving the seal ring assembly down onto the lower surface into sealing engagement with both such lower surface and the inner surface of the housing.

An object of the present invention is to provide an improved well annulus sealing assembly which has a long life in a corrosive environment.

Another object is to provide an improved well annulus sealing assembly which will not be subject to the seal ring moving out of its sealing position.

A further object is to provide an improved well annulus sealing assembly which is easily energized, avoids seal extrusion problems and is easily retrieved.

Another object is to provide an improved well annulus sealing assembly which is energized radially rather than by axial loading.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
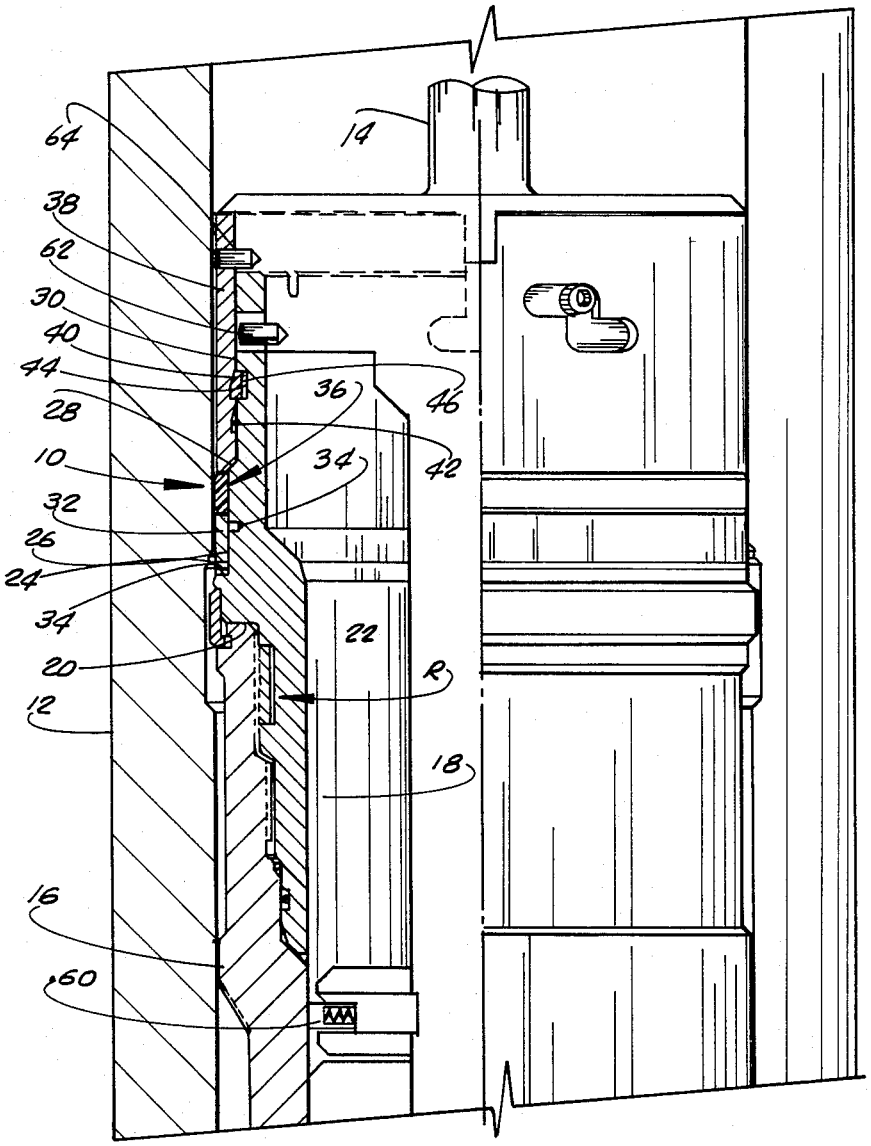
FIG. 1 is a partial sectional view of a well housing with the improved sealing assembly of the present invention shown in half section and with its running tool.

Improved sealing assembly 10 of the present invention is run into a well housing 12 on running tool 14. Sealing assembly 10 is landed on and connected to hanger 16 supported in housing 12 in a known manner. Tubular body 18 of sealing assembly 10 engages hanger 16 through the ratchet (spring loaded, threaded segments) connection R and has its external downwardly facing shoulder 20 engaged on upper surface 22 of hanger 16.

Figure 2:
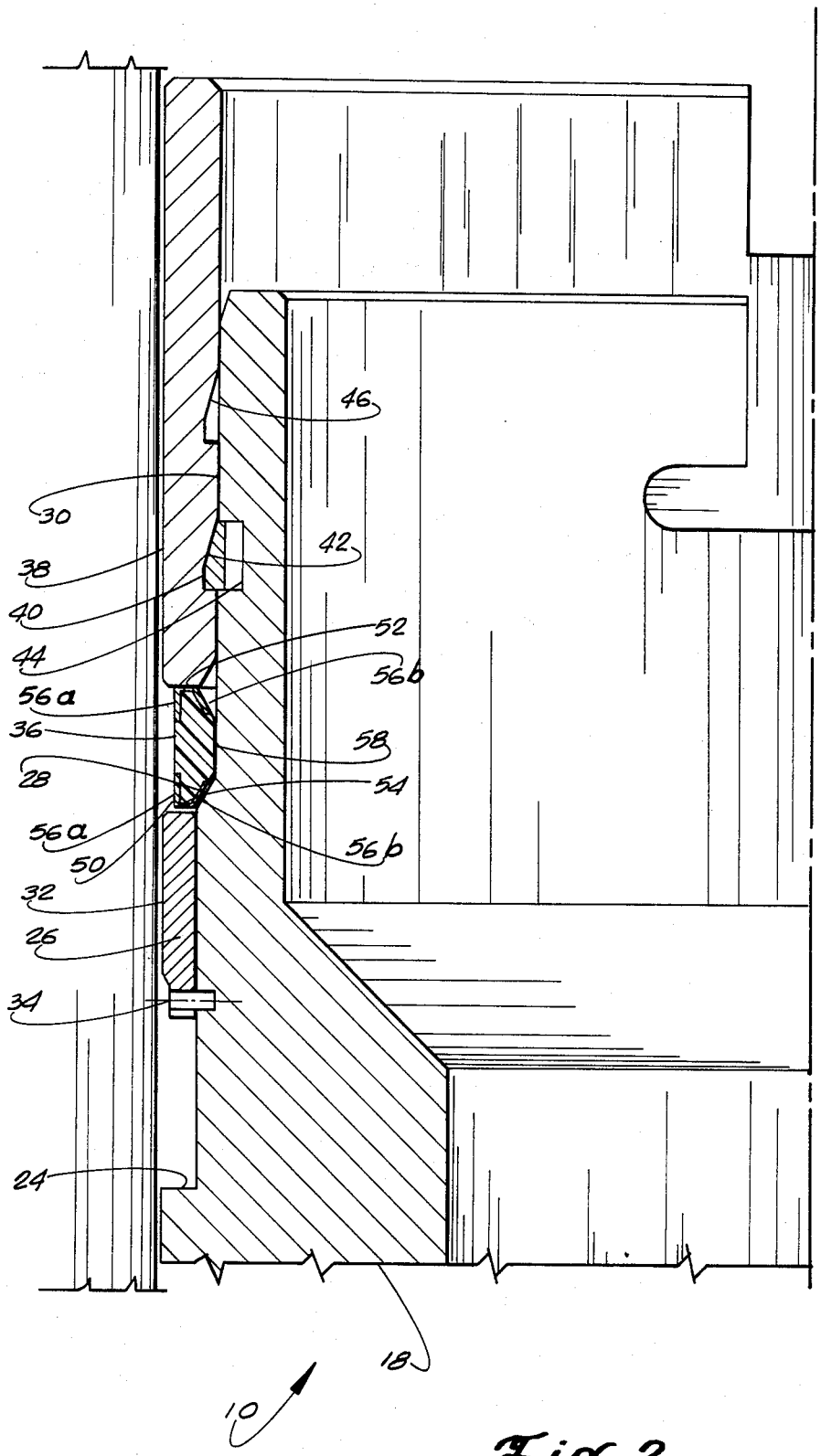
FIG. 2 is a partial sectional view of the unset or running position of the sealing assembly.

Sealing assembly 10 includes tubular body 18, having upwardly facing external shoulder 24, outer surface 26, inwardly and upwardly tapering surface 28, and upper surface 30 which is smaller in diameter than surface 26, back-up ring 32 surrounding and releasably connected to surface 26 by shear pin 34, seal ring assembly 36 above ring 32 and setting sleeve 38 above seal ring assembly 36. In the unset or running position as shown schematically in FIG. 2, running tool 14 being removed for clarity, back-up ring 32 is positioned around surface 26 and extends upward to the bottom of tapered surface 28 into abutting relationship with seal ring assembly 36. Setting sleeve 38 engages the upper end of seal ring assembly and surrounds surface 30. Tapered split ring 40 is positioned in groove 42 in sleeve 38 and in groove 44 in body 18. Split ring 40 and shear pin 34 retains sleeve 38, sealing assembly 36 and back-up ring 32 in position during running. If desired, a pin or pins in back-up ring sliding in a slot in the exterior of body 18 can be used to assist to maintain the elements in position on body 18 during running. Sleeve 38 has internal groove 46 above groove 42 for the purposes hereinafter set forth.

Seal ring assembly 36 includes resilient ring 48 having metal end caps 50 and 52 on its upper and lower ends as shown and preferably bonded thereto. End caps 50 and 52 have a central portion 54 with legs 56 (including inner legs **56*b* and outer legs 56*a*) extending upwardly and downwardly, respectively, in a direction toward the mid point of resilient ring 48. The inner central portion 58 of resilient ring 48 is convex and extends inward into light engagement or close spaced relationship with surface 30 in its unset position. It is preferred that resilient ring 48 be made of an elastomeric material, such as a nitrile rubber as sold by B. F. Goodrich Company under the trademark HYCAR, and metal end caps are a thin type 316** stainless steel.

Figure 3:
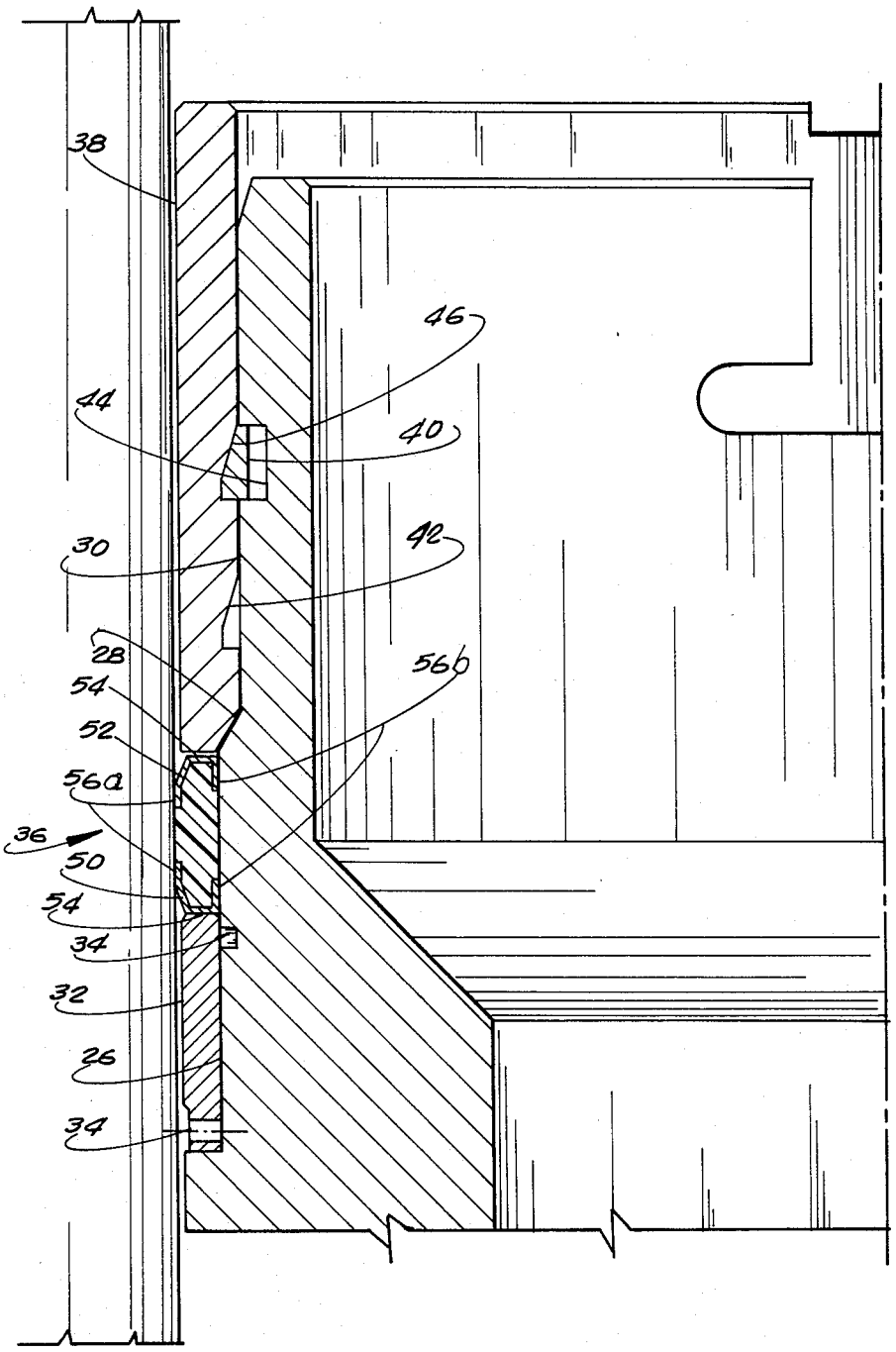
FIG. 3 is a view similar to FIG. 2 illustrating the set position of the sealing assembly.
Figure 4:
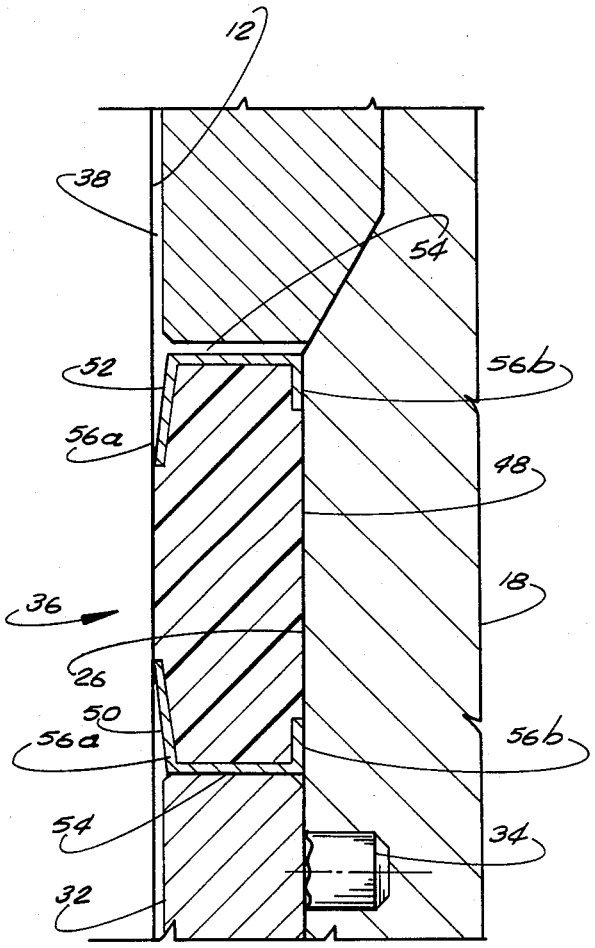
FIG. 4 is an enlarged partial sectional view of the set position of the seal ring assembly.

During running, sealing assembly 10 is supported on running tool 14 by pins 60 and 62. Upon landing of assembly 10 running tool 14 is rotated to tighten connection R and then it is lowered to cause pin 64 to engage sleeve 30 and move it downward to the position shown in FIG. 3. This downward movement shears pin 34 and moves seal ring assembly 36 downward onto outer surface 26. This downward movement of seal ring assembly 36 moves it radially outward on tapered surface 28 and onto larger diameter surface 26. Thus, this downward movement provides the radial energization of seal ring assembly 36 to move it to its sealing position between surface 26 and the inner surface of housing 12. In this position there is metal-to-metal seals of the legs 56*a* of end caps 50 and 52 with the sealing surfaces of housing 12 and body 18 because the inner central portion 58 of ring 48 is compressed radially outward which creates an internal force on the outer legs of the end caps outward, toward their related sealing surface. This force ensures that the inner legs 56*b* also are held in sealing engagement with surface 26. While this seal is energized by axial movement, which can be a weight set as shown, a screw set or other actuation, it creates the radial energizing of resilient ring 48 which ensures sealing and requires no axial load to maintain sealing after having been energized. During this setting movement of setting sleeve 38 the taper on groove 42 moves split ring 40 into groove 44 until sleeve 38 moves down to cause groove 46 to align with groove 44 at which position snap ring 40 moves into groove 46 and locks sleeve 38 against upward movement to thereby retain sealing assembly 10 in its set position. In this set position resilient ring 36 is free to expand axially but is restricted from radial movement by surface 26 and the inner surface of housing 18.

The improved sealing assembly provides a long life well annulus seal which is suitable for use in corrosive environments and is radially energized so that a thread or weight setting load are not necessary to maintain the seal. Further this assembly does not require the application and maintenance of a fluid under pressure to maintain the seal. There is no extrusion of the resilient ring by well pressure as it is completely encased at its ends by the end caps which provide the metal-to-metal annulus seal. Further if it becomes necessary to retrieve the seal assembly from the well bore this can be easily done by lifting the assembly upward in which case the metal end caps ensure that subsequent upward travel through the well bore does not pull off a section of the seal and possibly hang the seal assembly or drop a segment of the seal into the well.

What is claimed is:

1. A well sealing assembly for sealing between the interior surface of a housing and the exterior of a tubular body, said tubular body having a first exterior surface, a second exterior surface which has a larger diameter than said first exterior surface and a tapered surface between said first and second surfaces, comprising a seal ring assembly having a resilient ring with upper and lower flat surfaces, an interior convex surface and an exterior flat surface and annular metal end caps having flat portions bonded on said upper and lower flat surfaces of said resilient ring, inner legs tapering with the convex interior surface of said resilient ring and outer legs on the flat exterior surface of said resilient ring, the interior surface of said resilient ring being in close spaced relationship to said first surface of said tubular member when said seal ring assembly surrounds said first surface, and means for moving said seal ring assembly axially from its position surrounding said first surface of said tubular member, over said tapered surface and into its set position surrounding said second surface, said resilient ring having sufficient resiliency and volume to expand outward when moved to said set position to seal against said interior housing surface and to move the exterior legs of said end caps into metal-to-metal sealing engagement with said interior housing surface and to seal against said second surface with said interior legs in metal-to-metal sealing engagement with said second surface.

2. A well sealing assembly according to claim 1 wherein said resilient ring is an elastomer and said end caps are stainless steel.

3. A well sealing assembly according to claim 1 including means for releasably retaining said sealing assembly in position surrounding said first surface of said tubular.

4. A well sealing assembly according to claim 3 wherein said moving means includes a setting sleeve slidable on said first exterior surface of said tubular body, and means for moving said setting sleeve toward the second exterior surface of said tubular body with sufficient force to release said retaining means and to move said seal ring assembly over said tapered surface into its set position surrounding said second exterior surface.

* * * * *